US009768573B2

(12) United States Patent
Bichler

(10) Patent No.: US 9,768,573 B2
(45) Date of Patent: Sep. 19, 2017

(54) BRUSH UNIT AND SLIP-RING ARRANGEMENT HAVING A BRUSH UNIT

(71) Applicant: LTN Servotechnik GmbH, Otterfing (DE)

(72) Inventor: Bernhard Bichler, Rosenheim (DE)

(73) Assignee: LTN SERVOTECHNIK GMBH, Otterfing (DE)

( * ) Notice: Subject to any disclaimer, the term of this patent is extended or adjusted under 35 U.S.C. 154(b) by 316 days.

(21) Appl. No.: 14/597,245

(22) Filed: Jan. 15, 2015

(65) Prior Publication Data

US 2015/0222067 A1 Aug. 6, 2015

(30) Foreign Application Priority Data

Jan. 31, 2014 (EP) ..... 14000365

(51) Int. Cl.
*H01R 39/08* (2006.01)
*H01R 39/38* (2006.01)
*H01R 39/39* (2006.01)

(52) U.S. Cl.
CPC ..... *H01R 39/39* (2013.01); *H01R 39/08* (2013.01); *H01R 39/38* (2013.01)

(58) Field of Classification Search
CPC ..... H01R 39/08; H01R 39/18; H01R 39/26; H01R 39/39; H01R 39/36; H01R 39/643; H01R 4/48
USPC .... 310/219, 232, 239, 244, 248; 439/24, 26, 439/28
See application file for complete search history.

(56) References Cited

U.S. PATENT DOCUMENTS

| | | | | |
|---|---|---|---|---|
| 2,473,526 | A * | 6/1949 | Hood | H01R 39/00 191/1 R |
| 3,398,387 | A * | 8/1968 | Wendell | G01C 19/10 29/597 |
| 3,671,791 | A * | 6/1972 | Muller | H02K 13/003 310/219 |
| 4,296,345 | A * | 10/1981 | Haberl | H01R 39/00 310/219 |
| 4,639,629 | A | 1/1987 | Casanova | |
| 6,909,217 | B2 * | 6/2005 | Angerpointner | H01R 39/24 310/232 |
| 2015/0024610 | A1 | 1/2015 | Pollner | |

FOREIGN PATENT DOCUMENTS

| | | | |
|---|---|---|---|
| DE | 130228 | C | 6/1901 |
| DE | 836970 | C | 4/1952 |
| DE | 102012204830 | A1 | 9/2013 |
| GB | 883950 | A | 12/1961 |

* cited by examiner

*Primary Examiner* — Tran Nguyen
(74) *Attorney, Agent, or Firm* — Leydig, Voit & Mayer, Ltd.

(57) ABSTRACT

A brush unit for electrically contacting a curved surface of a slip ring includes a brush holder and a resilient brush. The resilient brush is mounted to the brush holder in such a way that the brush is resiliently preloaded between two points at which the brush is supported against the brush holder and exhibits a camber. The brush is in contact with the brush holder between the two points.

16 Claims, 3 Drawing Sheets

BRUSH UNIT AND SLIP-RING ARRANGEMENT HAVING A BRUSH UNIT

CROSS-REFERENCE TO PRIOR APPLICATION

Priority is claimed to European Patent Application No. EP 14 000 365.8, filed on Jan. 31, 2014, the entire disclosure of which is hereby incorporated by reference herein

FIELD

The present invention relates to a brush unit and a slip-ring arrangement having such a brush unit.

Typically, a slip-ring arrangement is composed, inter alia, of two subassemblies, namely a stator and a rotor. The stator often includes a plurality of brush units, whereas the rotor mostly includes a series of slip rings. During operation, brushes of the brush units are in sliding contact with the curved surfaces of the rotating slip rings. Such slip-ring arrangements are used in many technical fields to transmit electrical signals or electrical power from a stationary electrical unit to a rotating electrical unit or in the opposite direction.

BACKGROUND

German Laid Open Application DE 10 2012 204 830 A1 describes a brush block in which are mounted brushes which were previously plastically deformed.

Such a design has the disadvantage, inter alia, that the service lives of the sliding contact pairs of such slip-ring arrangements vary relatively strongly.

SUMMARY

In an embodiment, the present invention provides a brush unit for electrically contacting a curved surface of a slip ring. The brush unit includes a brush holder and a resilient brush. The resilient brush is mounted to the brush holder in such a way that the brush is resiliently preloaded between two points at which the brush is supported against the brush holder and exhibits a camber. The brush is in contact with the brush holder between the two points.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
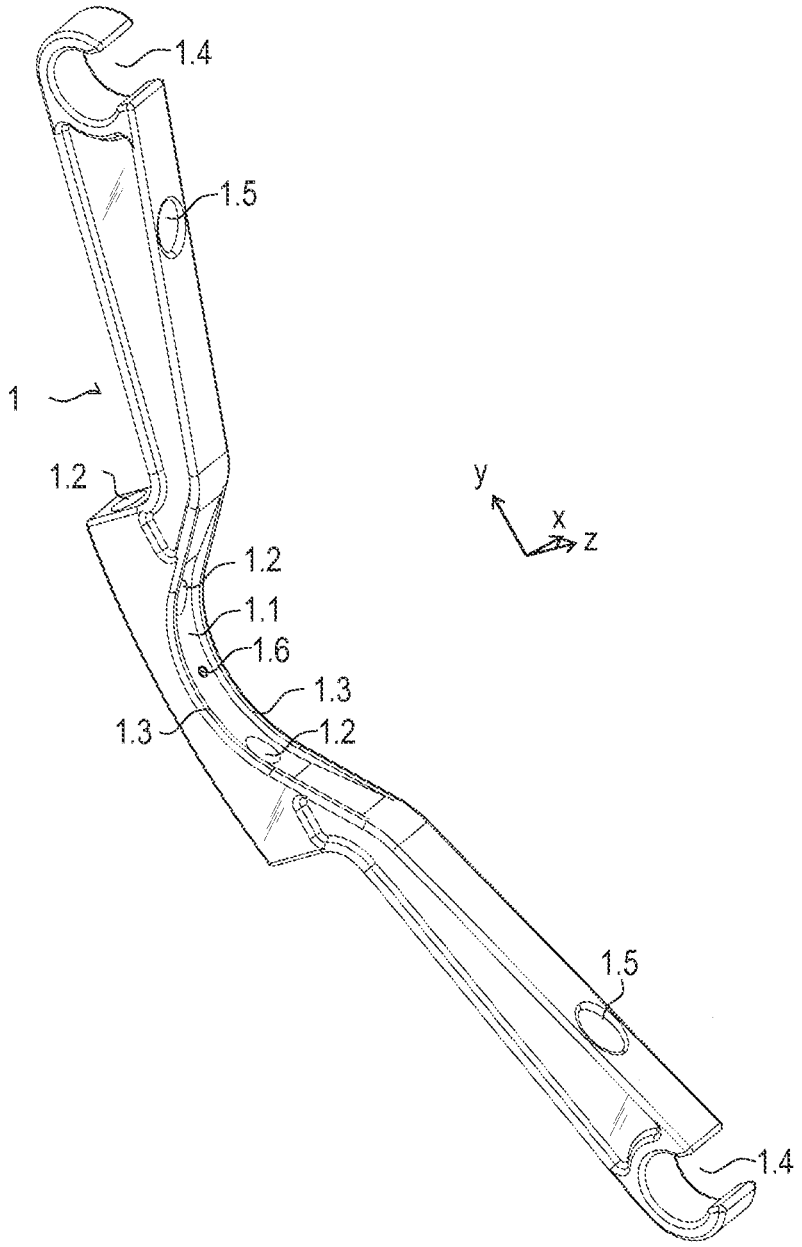
FIG. 1 is a perspective view of a brush holder.

In an embodiment, the present invention to provides, for a slip-ring arrangement, a brush unit which is highly reliable and at the same time simple and economical to manufacture.

According to an embodiment, a brush unit for electrically contacting a curved surface of a slip ring includes a brush holder and a resilient brush. The brush is mounted to the brush holder in such a way that it is resiliently preloaded between two points at which the brush is supported against the brush holder, and such that the brush exhibits a camber. Further, the brush is in contact with the brush holder between the two points.

The term "curved surface" is used herein in accordance with the geometric definition of a cylindrical body. The slip ring may be cylindrical, in particular hollow cylindrical, or annular.

In a further embodiment of the present invention, the brush holder may have a concave surface between the two points at which the brush is supported against the brush holder.

The arrangement of the brush is in particular such that it does not penetrate the brush holder, for example, through an opening. Rather, the brush is disposed only on one side of the brush holder and contacts the brush holder only on one side; i.e., on an outer surface of the brush holder, in particular in the region of the concave surface. Moreover, the brush is advantageously configured as a single piece.

The brush may be secured to the brush holder between the two points in such a way that the brush is urged toward the brush holder, in particular with the aid of fastening devices. Advantageously, the fastening devices may draw the brush toward the brush holder; i.e. the concave surface thereof, so that the fastening devices are subjected to a tensile stress resulting from the resilient preloading of the brush in the region of the camber. The brush may be urged toward the brush holder using, for example, a rivet or a screw as a fastening device.

The brush is advantageously in contact with the concave surface of the brush holder at a plurality of points or at a surface of the brush. In particular, the brush may be mounted to the brush holder in such a way that the camber of the brush is in (supporting) contact with the brush holder in the region of the concave surface.

In a further embodiment of the present invention, the brush has terminals for electrical contacting between the two points at which the brush is supported against the brush holder. These terminals may, for example, take the form of holes. Furthermore, contact elements, for example, in the form of sleeves, may be passed through the terminals configured as holes. The terminals are preferably disposed in the region of brush that is resiliently preloaded; i.e., in the region of the camber. In particular, if the forces for resiliently preloading the brush are introduced by the contact elements, the contact elements may define the elastically preloaded region of the brush.

The brush holder advantageously has ridges which retain the brush in the axial direction, thereby preventing or limiting movement of the brush in the axial direction. Accordingly, the brush may be disposed in a groove which retains the brush in the axial direction. The ridges are located axially on both sides of the concave surface.

The brush may in particular have two free ends for electrically contacting the curved surface of the slip ring. The free ends are resiliently movable in a direction orthogonal to axial direction x.

In a further embodiment of the present invention, the brush is in the form of an electrically conductive springy metal band.

An embodiment of the present invention also relates to a slip-ring arrangement including a slip ring having a curved surface, as well as a brush unit having a brush holder and a resilient brush, the brush electrically contacting the curved surface. Furthermore, the brush is mounted to the brush holder in such a way that the brush is resiliently preloaded between two points at which the brush is supported against the brush holder, and such that the brush exhibits a camber, the brush being in contact with the brush holder between the two points.

Preferably, the brush unit is configured such that the forces for supporting the brush relative to the brush holder are oriented tangentially with respect to the slip ring.

The slip-ring arrangement serves to transmit electrical power and/or electrical signals; i.e., to transmit information.

The slip-ring arrangement may be configured to include a plurality of slip rings arranged in series in the axial direction and a plurality of brush holders arranged in series in the axial direction.

Advantageously, the brush holders are axially spaced apart from each other.

Furthermore, the slip-ring arrangement may have holding elements, and the brush holder may have fastening elements, for example in the form of eyes, for attaching the brush holder to the holding elements.

The slip-ring arrangement advantageously has holding elements to which the brush holder is attached, the brush holder and the holding elements being arranged such that the brush holder is displaceable, in particular continuously displaceable, relative to the holding elements for relative axial adjustment.

In a further embodiment of the present invention, the holding elements are located on both sides of the camber of the brush with respect to the circumferential direction of the slip ring.

The brush unit according to an embodiment of the present invention allows the contact forces on a slip ring of a corresponding slip-ring arrangement to be generated in a relatively simple and reproducible manner within a very small tolerance range, thus making it possible to increase the durability or service life of a slip-ring arrangement.

Figure 2:
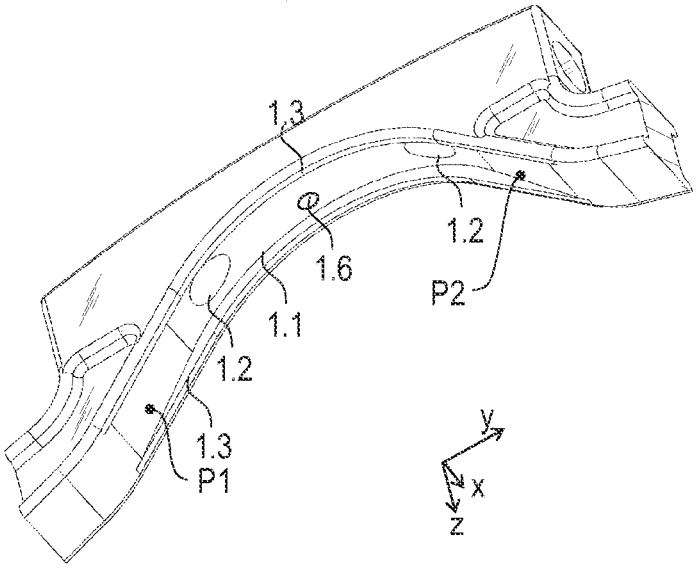
FIG. 2 is a perspective detail view of the brush holder.

FIG. 1 shows a brush holder 1 which, in the exemplary embodiment presented here, is made from an electrically non-conductive material. This brush holder 1 has a central concave surface 1.1 which is bounded in an x-direction by two ridges 1.3 (see also FIG. 2). Moreover, brush holder 1 has formed therein two bores or passages 1.2 extending along a y-direction and penetrating concave surface 1.1. Furthermore, brush holder 1 is provided at each of its ends with a fastening element 1.4, here in the form of an open eye, and has further bores or passages 1.5 which, in a first approximation, extend in the z-direction. Brush holder 1 also has a central bore 1.6.

Figure 3:
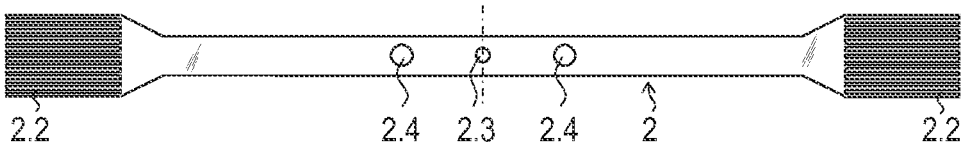
FIG. 3 is a plan view showing a brush in the uninstalled state.

In FIG. 3, a brush 2 is shown prior to being mounted to brush holder 1. Brush 2 takes the form of a relatively resilient electrically conductive metal band having slotted ends 2.2. The central portion of brush 2 is provided with a central hole 2.3 and two holes 2.4 located at the sides thereof.

Figure 4:
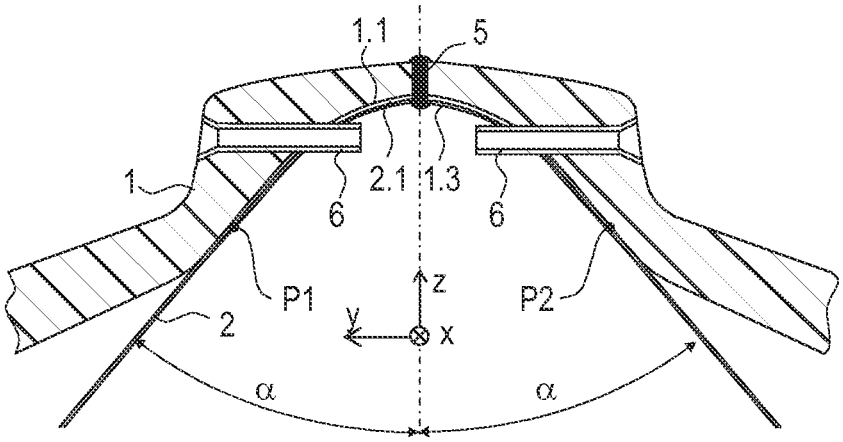
FIG. 4 is a partial cross-sectional view of a brush unit.

In the first exemplary embodiment (see FIG. 4), when brush holder 1 and brush 2 are joined to form a so-called brush unit, brush 2 is initially pressed against brush holder 1 in such a way that the brush is resiliently deformed and in contact with concave surface 1.1 of brush holder 1. Then, a fastening element 5, here a rivet, is pushed through central bore 1.6 of brush holder 1 and through central hole 2.3 of brush 2 and suitably deformed such that brush 2 is fixed to brush holder 1. Thus, in the mounted state, brush 2 is resiliently preloaded at least between two points P1, P2 at which brush 2 is supported, in particular in the y-direction, against brush holder 1, and such that brush 2 exhibits a camber 2.1. Between the two points P1, P2, brush 2 is in contact with brush holder 1, in particular with concave surface 1.1. In other words, camber 2.1 of brush 2 is in contact with brush holder 1, in particular with concave surface 1.1. Brush holder 1, in particular concave surface 1.1, serves to align brush 2, in particular to accurately position free ends 2.2. It is advantageous in this context when angle $\alpha$ is adjusted with high accuracy. In accordance with FIG. 4, angle $\alpha$ is the angle between a central axis oriented radially (in the z-direction) and the portions of the brush extending beyond camber 2.1; i.e., the non-preloaded portions on both sides of camber 2.1

Brush 2 is merely resiliently deformed; i.e., does not exhibit any plastic deformations or microstructural changes resulting therefrom. Therefore, in terms of resilience, the mechanical properties are very good for use in a slip-ring arrangement.

An electrically conductive contact element 6 (here in the form of a sleeve 6) is then pushed through one of passages 1.2 and a hole 2.4 of brush 2 (see FIG. 4) and electrically contacted to brush 2, for example by a soldered connection. Then, stranded conductors of electrical cables are inserted into contact elements 6 and soldered thereto. The stranded conductors are passed through passages 1.5 extending substantially in the z-direction (see FIG. 1), so that passages 1.5 also act as strain relief. To this end, the stranded conductors passed through passages 1.5 may be potted in passages 1.5.

Figure 5:
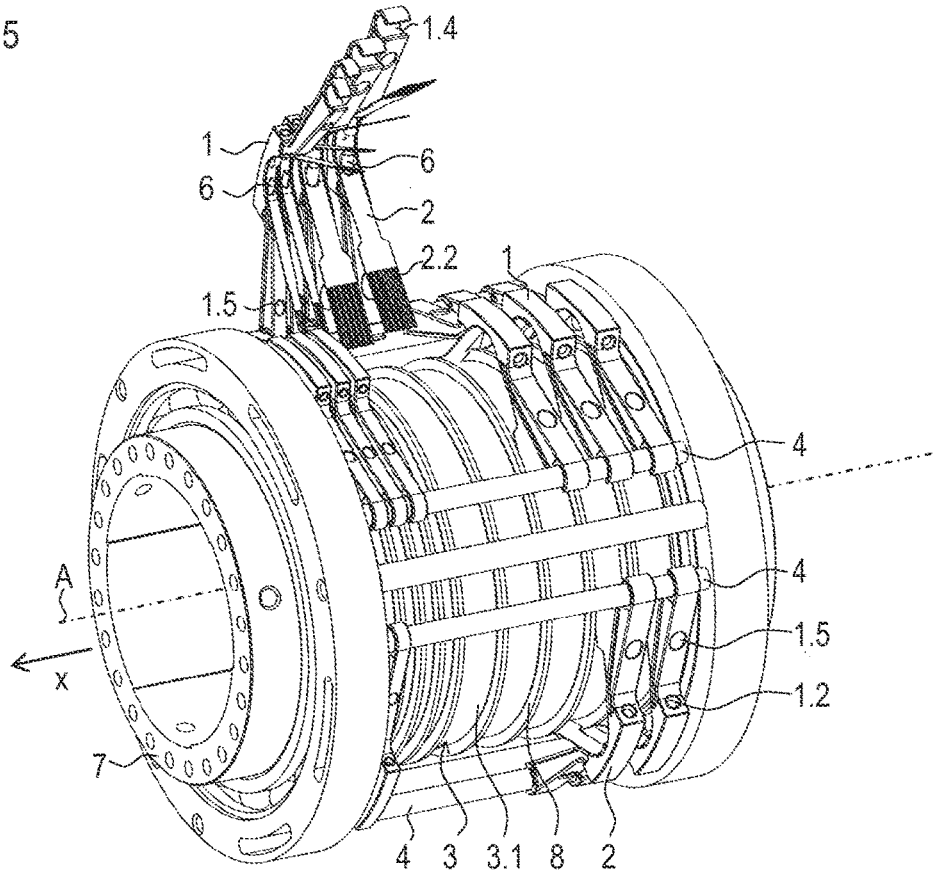
FIG. 5 is a perspective view of a slip-ring arrangement.

FIG. 5 shows a slip-ring arrangement including a plurality of brush units (i.e., a plurality of brush holders 1 and brushes 2), as well as slip rings 3 arranged in series in axial direction x. For purposes of demonstration only, three brush units are shown in FIG. 5 in, as it were, a folded-up position; i.e., in a position other than the normal operating position. Slip rings 3 are axially spaced apart and separated from each other by electrically insulating rings 8. Each slip ring 3 has a cylindrical curved surface 3.1. Slip rings 3 are non-rotatably mounted at their inner sides on a support tube 7, and such that they are electrically insulated from one another. Curved surfaces 3.1 are electrically contacted by brushes 2. Furthermore, slip rings 3 are contacted by stranded conductors for transmission of signals or electrical power.

Brush holders 1 are attached by their fastening elements 1.4 to holding elements 4, in particular by means of a clip mechanism. Accordingly, in this mounting position, holding elements 4 are located on both sides of camber 2.1 of brush 2 with respect to the circumferential direction of slip rings 3.

The slip-ring arrangement is configured such that brush holders 1 are arranged in series in axial direction x; i.e., axially spaced apart from each other. This means in particular that an axial air gap exists between adjacent brush holders 1 or adjacent brush units. This makes it possible to individually adjust the axial positions of the individual brushes 2 relative to their associated slip rings 3, so that dimensional tolerances can be compensated for. The presented type of attachment of brush holders 1 to holding elements 4 using fastening elements 1.4 is advantageous in this connection. This attachment is by frictional engagement and designed such that when a sufficiently high force is applied, a continuous axial displacement for purposes of relative axial adjustment of an individual brush holder 1 along holding elements 4 of brush holders 1 is possible.

The operation of the slip-ring arrangement is often such that the brush unit and holding element 4 are stationary; i.e., associated with a stator, whereas slip rings 3 and support tube 7 act as a rotor.

The slip-ring arrangement serves to transmit electrical currents between the rotor and the stator. The rotor and the stator are arranged about an axis A extending in the x-direction and are rotatable relative to each other. During rotation, each of the brushes 2 slidingly contacts the curved surface 3.1 of a respective one of slip rings 3. In the exemplary embodiment presented here, the curved surface 3.1 of a slip ring 3 is contacted twice by a brush 2 in each brush unit, since each brush 2 has two legs, each having a free end 2.2. Ends 2.2 are radially movable due to the resiliency of brush 2. For proper transmission of signals and/or power, it is important that brush 2; i.e., their ends 2.2, contact curved surface 3.1 with a precisely predetermined preload or contact force and at a defined angle relative to curved surface 3.1. The brush unit according to the present invention ensures that the above-mentioned force and geometrical requirements can be achieved reproducibly and accurately with relatively little complexity.

In order to prevent brushes 2 from being displaced relative to brush holder 1 in the axial direction; i.e., in the x-direction, during operation, brush holders 1 are provided with ridges 1.3, so that brushes 2 are form-lockingly retained in the axial direction. This aspect also includes the feature according to which brushes 2 are guided by ridges 1.3 in such a way that they, especially their free ends 2.2, are no longer able to cross each other.

Figure 6:
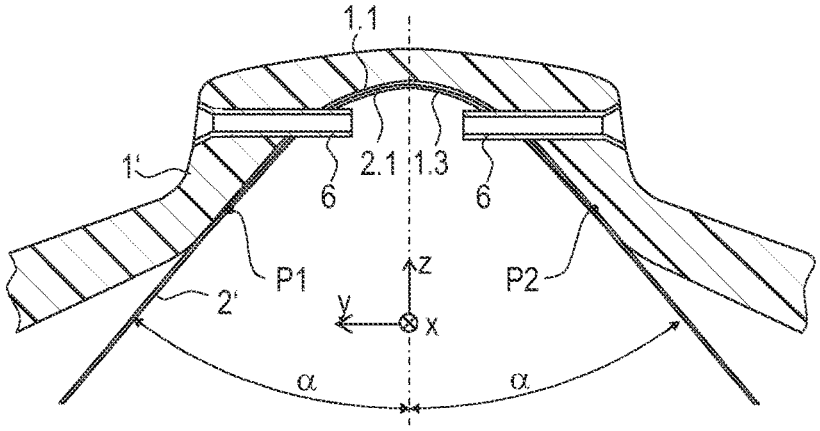
FIG. 6 is a partial cross-sectional view of a brush unit.

In a second exemplary embodiment shown in FIG. 6, brush holder 1' and brush 2' do not have any central passage or central hole, respectively. In the second exemplary embodiment, when brush holder 1' and brush 2' are joined to form a so-called brush unit, brush 2' is initially pressed against brush holder 1' in such a way that brush 2' is resiliently deformed and in contact with concave surface 1.1 of brush holder F. In contrast to the first exemplary embodiment, an electrically conductive contact element 6 is pushed through each of passages 1.2 and a hole 2.4 of brush 2' and electrically contacted to brush 2' by a soldered connection already in this phase. In the second exemplary embodiment, the electrical contacting serves at the same time for mechanical attachment. Thus, in the mounted state, brush 2' is resiliently preloaded at least between two points P1, P2 at which brush 2' is supported against brush holder 1' and at which brush 2' is electrically contacted, and such that brush 2' exhibits a camber 2.1. Here, too, brush 2' is in contact with brush holder 1', in particular with concave surface 1.1, between the two points P1, P2. Thus, in the design according to the second exemplary embodiment, brush 2' is not drawn toward concave surface 1.1 with the aid of an additional fastening device. Rather, the contact between brush 2' and concave surface 1.1 is merely obtained by the resilient preloading of brush 2'. Retention of brush 2' in the axial direction (in the x-direction) is accomplished by ridges 1.3 in a form-locking manner.

The connection of contact elements 6 to corresponding stranded conductors is effected as in the first exemplary embodiment.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A brush unit for electrically contacting a curved surface of a slip ring, the brush unit comprising:

a brush holder; and a resilient brush mounted to the brush holder in such a way that the brush is resiliently preloaded between two points, the brush being supported at the two points against the brush holder and exhibiting a camber, the brush being in contact with the brush holder between the two points, wherein the brush holder has a concave surface between the two points.

2. The brush unit as recited in claim 1, wherein the brush is secured to the brush holder between the two points with the aid of one or more fastening devices in such a way that the brush is urged toward the brush holder.

3. The brush unit as recited in claim 1, wherein the brush has terminals configured to electrically contact between the two points.

4. The brush unit as recited in claim 3, wherein the terminals are configured as holes, and wherein contact elements are passed through the holes.

5. The brush unit as recited in claim 1, wherein the brush holder has ridges, the ridges retaining the brush in an axial direction.

6. The brush unit as recited in claim 1, wherein the brush has two free ends.

7. The brush unit as recited in claim 1, wherein the brush is configured as a metal band.

8. A slip-ring arrangement, comprising a slip ring having a curved surface;

a brush unit having a brush holder and a resilient brush, the brush electrically contacting the curved surface, wherein the brush is mounted to the brush holder in such a way that the brush is resiliently preloaded between two points, the brush being supported at the two points against the brush holder and exhibiting a camber, the brush being in contact with the brush holder between the two points; and holding elements, wherein the brush holder has fastening elements configured to attach the brush holder to the holding elements.

9. The slip-ring arrangement as recited in claim 8, wherein the slip-ring arrangement includes a plurality of slip rings arranged in series in an axial direction and a plurality of brush holders arranged in series in the axial direction.

10. The slip-ring arrangement as recited in claim 9, wherein brush holders are axially spaced apart from each other in the axial direction.

11. The slip-ring arrangement as recited in claim 8, further comprising holding elements, the brush holder being attached to the holding elements, the brush holder and the holding elements being arranged such that the brush holder is displaceable relative to the holding elements for a relative axial adjustment.

12. The slip-ring arrangement as recited in claim 8, wherein the holding elements are located on both sides of the camber of the brush with respect to a circumferential direction.

13. A brush unit for electrically contacting a curved surface of a slip ring, the brush unit comprising:

a brush holder; and a resilient brush mounted to the brush holder in such a way that the brush is resiliently preloaded between two points, the brush being supported at the two points against the brush holder and exhibiting a camber, the brush being in contact with the brush holder between the two points, wherein the brush is secured to the brush holder between the two points with the aid of one or more fastening devices in such a way that the brush is urged toward the brush holder.

14. A brush unit for electrically contacting a curved surface of a slip ring, the brush unit comprising:

a brush holder; and a resilient brush mounted to the brush holder in such a way that the brush is resiliently preloaded between two points, the brush being supported at the two points against the brush holder and exhibiting a camber, the brush being in contact with the brush holder between the two points, wherein the brush is secured to the brush holder between the two points with the aid of one or more fastening devices in such a way that the brush is urged toward the brush holder.

15. The brush unit as recited in claim 14, wherein the terminals are configured as holes, and wherein contact elements are passed through the holes.

16. A brush unit for electrically contacting a curved surface of a slip ring, the brush unit comprising:

a brush holder; and a resilient brush mounted to the brush holder in such a way that the brush is resiliently preloaded between two points, the brush being supported at the two points against the brush holder and exhibiting a camber, the brush being in contact with the brush holder between the two points, wherein the brush holder has ridges, the ridges retaining the brush in an axial direction.

* * * * *